US005192216A

United States Patent [19]

Knauber et al.

[11] Patent Number: 5,192,216

[45] Date of Patent: Mar. 9, 1993

[54] APPARATUS FOR GROUNDING CONNECTORS TO INSTRUMENT CHASSIS

[75] Inventors: Steven K. Knauber; Daniel Reiswig, both of Grass Valley, Calif.

[73] Assignee: The Grass Valley Group, Inc., Nevada City, Calif.

[21] Appl. No.: 789,492

[22] Filed: Nov. 8, 1991

[51] Int. Cl.[5] ..... H01R 13/648

[52] U.S. Cl. ..... 439/108; 439/579; 439/609

[58] Field of Search ..... 439/95, 96, 101, 108, 439/620, 567, 579, 607, 609

[56] References Cited

U.S. PATENT DOCUMENTS 3,366,918 1/1968 Johnson et al. ..... 439/607
4,386,814 6/1983 Asick ..... 439/95 X
4,541,683 10/1985 Van Domelen ..... 339/126 R

*Primary Examiner*—Eugene F. Desmond
*Attorney, Agent, or Firm*—John Smith-Hill; James H. Walters

[57] ABSTRACT

An apparatus for providing an electrical connection between an electrical connector and a conductive chassis member includes aligned connector holes in the chassis, a thin ground sheet of springy and conductive material and a thicker support plate. The holes in the thin ground sheet have a periphery that includes alternating gaps and extensions, with the dimension defined by the gaps being larger than the corresponding dimension of the barrel of the electrical connector and the dimension defined by the extensions being smaller than the dimension of the barrel. The thin ground sheet is held in physical and electrical contact with and parallel to the conductive chassis member by the support plate, which is also preferably of conducting material, and a set of screws. When the barrels of electrical connectors associated with a PC board inside of the instrument are made to pass through the aligned apertures in the thicker support plate, the thin ground sheet and the conductive chassis member, respectively, the barrels of the electrical connectors contact the extensions and cause them to bend so that they remain in electrically conducting contact with the barrels of the connectors thereby grounding with connectors to the instrument chassis.

14 Claims, 2 Drawing Sheets

APPARATUS FOR GROUNDING CONNECTORS TO INSTRUMENT CHASSIS

BACKGROUND OF THE INVENTION

This invention relates to the grounding of electrical connectors, and more particularly to apparatus for cost-effectively creating a high quality ground connection between a BNC connector and the conductive enclosure of an instrument.

If a coaxial cable is connected to an instrument with inadequate grounding and high frequency signals are present within the instrument, the cable may transmit electromagnetic interference (EMI) into the surrounding environment. Since transmitted EMI is regulated by the Federal Communications Commission (FCC) in the United States and even more strictly in the Federal Republic of Germany by the VDE, Verband Deutscher Elektrotechniker (Association of German Electrical Engineers), such transmissions may constitute an unacceptable behavior of the instrument that renders it unmarketable in a number of important countries.

In many instruments, the BNC connectors are mounted on the conductive instrument enclosure or chassis, and the conductors are then separately wired to a printed circuit board (PCB) within the instrument. Although this process produces excellent grounding, it is very labor intensive and therefore undesirable, if it can be avoided.

Mounting BNC connectors directly on the PCBs generally helps to hold down manufacturing costs, but, when this is done, a suitable means of making a high quality electrical connection to the instrument's chassis (or local earth) ground must be found.

One prior method of grounding BNC connectors to instrument enclosures has been to solder a separate beryllium copper metal sleeve with flared out extensions to each BNC connector. Then, when the instrument cover is pressed against the flared out extensions during assembly, they provide a good electrical contact between the instrument case and the BNC connector. These sleeves were slitted to allow them to fit over the locking pins on the barrel of the female BNC connectors, and, with their flared out extensions, somewhat resemble a crown. While this approach provides a good ground connection, it is far too labor intensive for mass production applications in which the desire is to be inexpensive by requiring limited labor.

SUMMARY OF THE INVENTION

In accordance with the invention, there is provided an apparatus for providing an electrical connection between an electrical connector and a conductive chassis member that includes aligned connector holes in the chassis, a thin ground sheet of springy (stiff but readily bendable and resilient) and conductive material and a thicker support plate. The holes in the thin ground sheet have a periphery that includes alternating gaps and extensions, with the diameter defined by the gaps being larger than the diameter of the barrel of the electrical connector and the diameter defined by the extensions being smaller than the diameter of the barrel of the connector. The thin ground sheet is held in physical and electrical contact with and parallel to the conductive chassis member by the support plate, which is also preferably of conducting material, and a set of screws. When the barrels of electrical connectors associated with a PCB inside of the instrument are made to pass through the aligned apertures in the support plate, the thin ground sheet and the conductive chassis member, respectively, the barrels of the electrical connectors contact the extensions and cause them to bend so that they remain in electrically conducting contact with the barrels of the connectors thereby grounding the connectors to the instrument chassis.

BRIEF DESCRIPTION OF THE DRAWINGS

For a better understanding of the invention, and to show how the same may be carried into effect, further reference will be made, by way of example, to the accompanying drawings in which.

DETAILED DESCRIPTION

Figure 1:
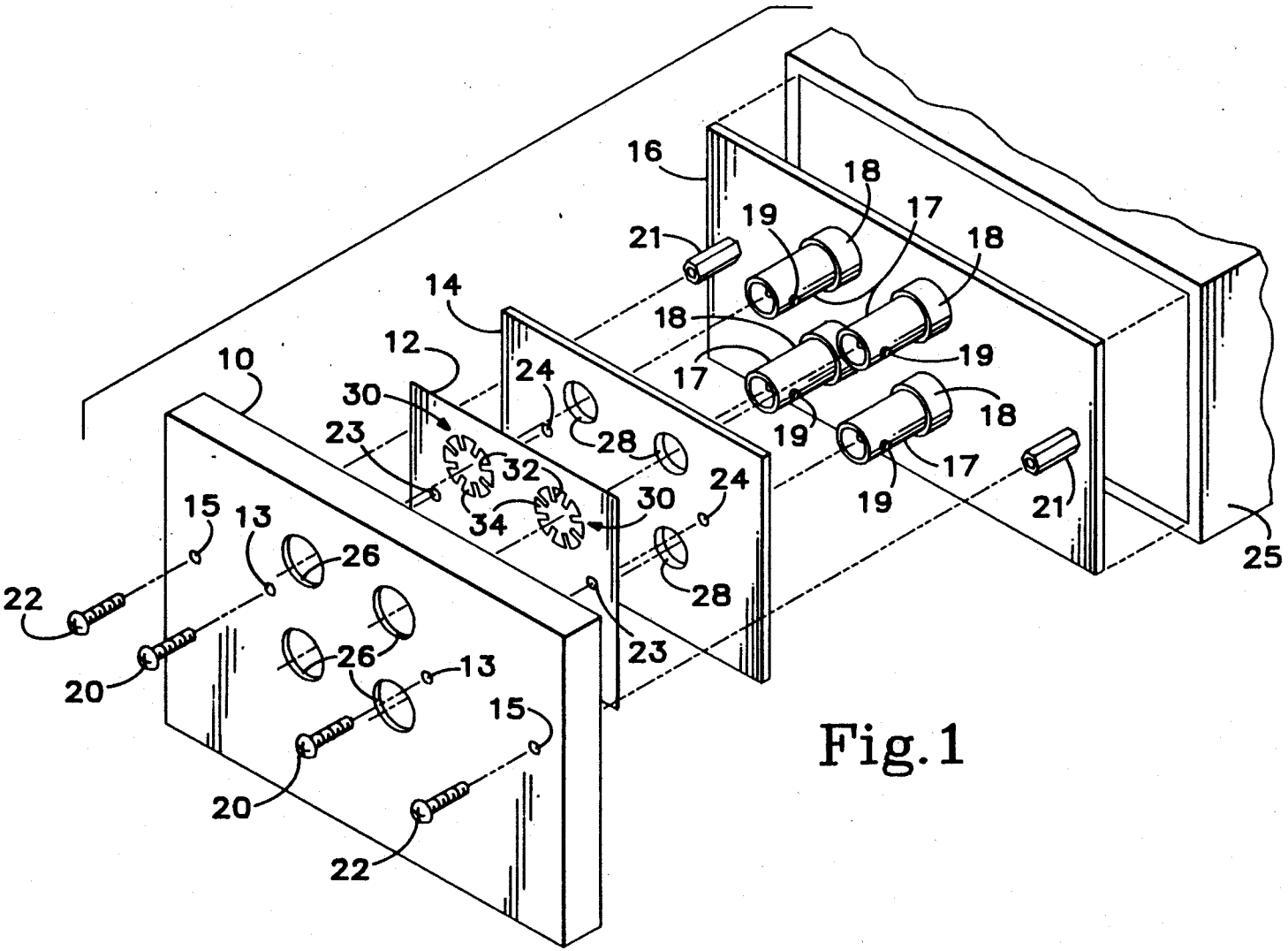
FIG. 1 is perspective exploded view of a connector to chassis grounding apparatus according to the present invention.

FIG. 1 is perspective exploded view of a connector to chassis grounding apparatus according to the present invention. It shows a section of conductive instrument chassis 10 having a number of holes. These include chassis connector clearance holes 26, first chassis screw clearance holes 13 and second chassis screw clearance holes 15. In front of the section of chassis 10 there are first chassis screws 20 aligned with the first chassis screw clearance holes 13, and second chassis screws 22 aligned with the second chassis screw clearance holes 15.

Behind the section of chassis 10 there is a springy and conductive thin ground sheet 12. The thin ground sheet 12 is provided with thin ground sheet connector holes 30 and thin ground sheet screw clearance holes 23, aligned respectively with the chassis connector clearance holes 26 and first chassis screw clearance holes 13. The thin ground sheet connector holes 30 have around their periphery alternating "fingers" 32 and gaps 34, both of which will be further described below.

Behind the thin ground sheet 12 there is a thicker support plate 14. The support plate 14 is provided with support plate connector holes 28 and support plate screw tapped holes 24, which are also aligned respectively with the chassis connector clearance holes 26 and first chassis screw clearance holes 13.

Behind the support plate 14 there is shown a printed circuit board (PC board) 16 on which there are mounted 50 Ω BNC connectors 18 and stand-offs 21. Each BNC connector 18 has a barrel 17 with two BNC locking pins 19 disposed on its sides 180° apart. The stand-offs 21 present a threaded screw hole that is aligned with the second chassis screw clearance holes 15 on the section of chassis 10. The conductive instrument chassis 25, that all of this fits into or is secured to, is shown behind the PC board 16.

When assembled, first chassis screws 20 pass through first chassis screw clearance holes 13 and thin ground sheet screw clearance holes 23 and into support plate screw tapped holes 24, which are threaded. These screws serve to draw the support plate 14 and the section of chassis 10 together, sandwiching the thin ground sheet 12 firmly between them in the process. Since all of these parts are preferably conductive, the result is excellent electrical contact between the thin ground sheet 12, the section of chassis 10 and, after further assembly, the instrument chassis 25.

During further assembly of the instrument the barrels 17 of the BNC connector 18 affixed to the PC board 16 are inserted through the support plate connector holes 28, the thin ground sheet connector holes 30 and the chassis connector holes 26. The PC board 16 is secured to the section of chassis 10 by second chassis screws 22. The second chassis screws 22 pass through second chassis screw clearance holes 15 and engaged threads in stand-offs 21. The stand-offs 21 and the bases of the BNC connectors 18 prevent contact between the conductive support plate 14 and any exposed runs on the PC board 16.

The thin ground sheet 12 is made of a springy (stiff but readily bendable and resilient) and conductive material such as high strength beryllium copper alloy that is 1.8% to 2.0% beryllium, at least 0.2% cobalt and nickel combined, with a total of cobalt, nickel and iron that is less than 0.6%, and the balance of the composition being copper. This beryllium copper alloy has electrical conductivity of approximately 22% IACS (International Annealed Copper Standard). The thermal expansion coefficient of beryllium copper closely matches that of stainless steel, the preferred material for the conductive instrument chassis 25 and support plate 14. Stainless steel and beryllium copper are also quite compatible in terms of galvanic activity, and therefore can be used in close contact with each other without any adverse corrosive consequences. Although it provides adequate conductivity and is compatible with a stainless steel environment, it is primarily the high strength, resilience and elasticity of this beryllium copper alloy that make it preferable for this application.

While a thin ground sheet 12 thickness of 0.003 inches (0.0076 cm) has been found to be ideal in one embodiment of the invention, thickness of from 0.001 inches to 0.01 inches (0.0025 cm to 0.025 cm) would all function satisfactorily and might be preferable if a somewhat different material were used for the thin ground sheet 12.

Figure 2:
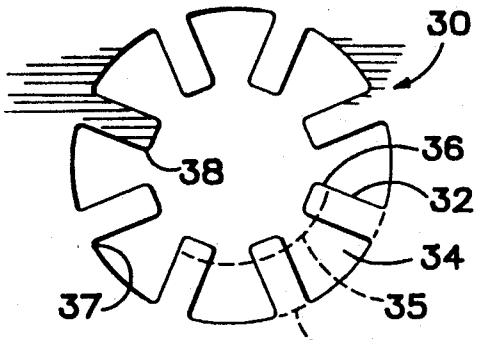
FIG. 2 is plan view of the fingers and gaps used in the apparatus of the present invention.

Referring to FIG. 2, the details of the thin ground sheet connector holes 30 will now be described. In one embodiment, each thin ground sheet connector hole 30 has eight "fingers" 32 of the springy and conductive material of the thin ground sheet 12 disposed around its periphery at 45° intervals. Gaps 34 separate each pair of adjacent fingers 32. The corners 37 between the gaps 34 and the fingers 32 and the corners 38 at the ends of the fingers 32, are rounded with a radius that is typically 0.010 inches (0.025 cm). This helps to prevent tearing between the fingers 32 and gaps 34, and the scratching of the barrel 17 of the BNC connector 18 by the tips 36 of the fingers 32. (The significance of the tips 36 will be further described below.)

Each thin ground sheet connector hole 30 has a diameter across its outer circumference 33 of 0.600 inches (1.52 cm) and each finger has a width of 0.060 inches (0.15 cm) and a length of 0.135 inches (0.343 cm). The minimum distance between two diametrically opposite fingers is 0.330 inches (0.838 cm). The diameter of the barrel 17 of the connector 18 is 0.380 inches (0.965 cm), which exceeds the minimum distances between two diametrically opposite fingers by 0.050 inches (0.128 cm).

Figure 4:
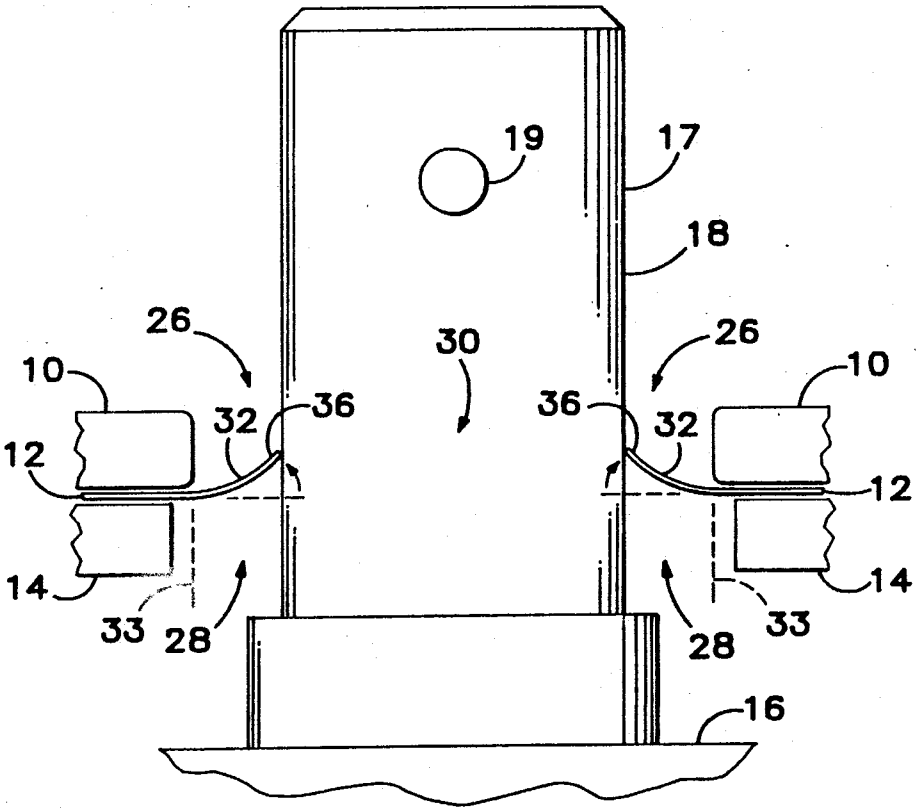
FIG. 4 is cross-sectional view of the connector to chassis grounding apparatus according to the present invention with a BNC connector inserted in it.

Referring now to FIG. 4, when the barrel 17 of the BNC connector 18 is inserted through the support plate 14 connector hole 28, the thin ground sheet connector hole 30 and the chassis connector hole 26, the fact that the minimum distance between two diametrically opposite fingers is less than the diameter of the barrel 17 of the connector results in the fingers 32 bending and their tips 36 remaining in contact with the metal of the barrel 17. The gaps 34 between the fingers 32 permit the fingers 32 to bend readily and also provide a path for the BNC locking pin 19 on the barrel 17 of the BNC connector 18 to slide through the thin ground sheet connector hole 30.

In the example shown in FIG. 4, the BNC connector 18 barrel 17 has a diameter of 0.380 inches (0.965 cm), while the diameter of the support plate 14 connector hole 28 is 0.630 inches (1.60 cm), the diameter of the thin ground sheet 12 connector hole 30 is 0.600 inches (0.153 cm) and the diameter of the chassis 10 connector hole 26 is 0.590 inches (1.50 cm).

Figure 3:
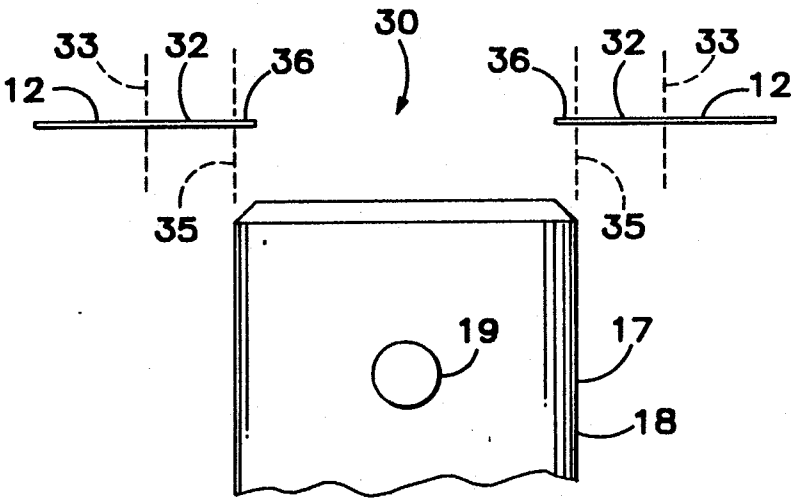
FIG. 3 is cross-sectional view of the relationship between the fingers of the thin ground sheet and the diameter of a BNC connector.

Referring to FIGS. 1, 2 and 3, the gaps 34 between the fingers 32 are oriented relative to the orientation of the BNC locking pins 19 on the connector barrels 17 so that the BNC locking pins 19 pass through the gaps 34 rather than interacting with the fingers 32. This is not strictly necessary, as the BNC locking pins 19 only protrude from the connector barrel 17 by 0.025 inches (0.064 cm), so that if the BNC locking pin 19 fully interacted with a finger 17 there would still be 0.085 inches (0.216 cm) of finger 17 available for bending. However, to avoid unnecessary stress and metal fatigue it is preferable to obtain at least moderately correct alignment, so that such interaction is minimized if not avoided. Moderately incorrect alignment is not a problem, since the fingers 17 can twist as well as bend to permit the passage of the BNC locking pins 19.

While a preferred embodiment of the present invention has been shown and described, it will be apparent to those skilled in the art that many changes and modifications may be made without departing from the invention in its broader aspects. For example, while the thin ground sheet 12 and support plate 14 are shown above as being secured to the inside of the chassis, it might be desirable in some applications to secure them both to the outside instead. Also, while a circular connector has been illustrated, the teaching of this invention can readily be applied to connectors having other shapes. The claims that follow are therefore intended to cover all such changes and modifications as fall within the true scope of the invention.

We claim:

1. An apparatus comprising:

an electrical connector having a conductive barrel;

a conductive chassis member defining an aperture with a dimension that is larger than a corresponding dimension of the barrel;

a thin, substantially planar ground sheet of springy and conductive material defining an aperture, with the aperture in the thin ground sheet having a periphery that includes a plurality of alternating gaps and extensions, said extensions being substantially coplanar with said ground sheet, with a dimension defined by the gaps being larger than the corresponding dimension of the barrel, and a dimension defined by the extensions being smaller than the corresponding dimension of the barrel, the thin ground sheet being in electrical contact with and parallel to the conductive chassis member; and means for securing the thin ground sheet to the chassis member with the apertures in the thin ground sheet and the conductive chassis member in alignment;

whereby, when the barrel of the electrical connector is made to pass through the aperture in the thin ground sheet and the aperture in the conductive chassis member, the barrel of the electrical connector contacts the extensions causing the extensions to bend so that the extensions of the thin ground sheet remain in electrically conducting contact with the barrel of the electrical connector thereby grounding the electrical connector to the conductive chassis member.

2. An apparatus according to claim 1 wherein the thin ground sheet has a thickness within the range of 0.001 inches to 0.01 inches (0.0025 cm to 0.025 cm).

3. An apparatus according to claim 1 wherein the thin ground sheet comprises a beryllium copper alloy.

4. An apparatus according to claim 3 wherein the conductive chassis member comprises stainless steel.

5. An apparatus according to claim 1 wherein the plurality of alternating gaps and extensions are spaced appropriately for permitting a BNC locking pin on the barrel to pass between adjacent extensions without contacting the extensions.

6. An apparatus according to claim 1, wherein the conductive barrel is substantially cylindrical and has two locking pins projecting therefrom at diametrically opposite positions, and the apparatus further comprises means for attaching the electrical connector to the conductive chassis member in a predetermined position such that the barrel extends through the aperture in the chassis member and the aperture in the thin ground sheet and is oriented so that the locking pins are at substantially the same angular positions as two of said gaps at the periphery of the aperture defined by the thin ground sheet.

7. An apparatus according to claim 1, comprising alignment means for positioning the barrel at a predetermined angular position relative to the aperture for insertion of the barrel through the aperture, the angular position of the barrel being such that the pins are aligned with respective gaps at the periphery of the aperture defined by the thin ground sheet.

8. An apparatus according to claim 1 wherein the means for securing comprises a thicker support plate of material adjacent to and parallel with the thin ground sheet, the thicker support plate defining an aperture that aligns in location with the aperture in the thin ground sheet.

9. An apparatus according to claim 8 wherein the plurality of alternating gaps and extensions are spaced appropriately for permitting a BNC locking pin on the barrel to pass between adjacent extensions without contacting the extensions.

10. An apparatus according to claim 8 wherein the thin ground sheet has a thickness within the range of 0.001 inches to 0.01 inches (0.0025 cm to 0.025 cm).

11. An apparatus according to claim 8 wherein the thin ground sheet comprises a beryllium copper alloy.

12. An apparatus according to claim 11 wherein the conductive chassis member and the support plate comprise stainless steel.

13. A electrical apparatus comprising:

an electrical conductor having a substantially cylindrical conductive barrel;

a conductive chassis member defining a substantially circular aperture of which the diameter is larger than the diameter of the barrel;

a thin ground sheet of springy and conductive material comprising a planar major portion having a substantially circular interior boundary of which the diameter is greater than the diameter of the barrel, and finger portions that are substantially coplanar with the major portion of the sheet and project from the periphery of said boundary in a substantially radially inward direction, whereby the ground sheet defines a generally circular aperture with inwardly projecting finger portions and wherein the length of each finger portion is greater than the difference between the radius of the barrel and the radius of the periphery of said boundary; and means securing the ground sheet to the chassis member with the ground sheet in electrically conductive contact with and parallel to the chassis member and with the aperture in the ground sheet in alignment with the aperture in the conductive chassis member, whereby upon insertion of the electrical connector through the aperture in the ground sheet and the aperture in the conductive chassis member, the barrel of the connector engages and deflects the finger portions of the ground sheet so that electrically conductive connection is established between the ground sheet and the barrel of the connector.

14. An apparatus according to claim 13 wherein the finger portions of the ground sheet are spaced apart around the periphery of said boundary, the barrel has two locking pins projecting radially therefrom at diametrically opposite positions, and the apparatus comprises means for aligning the connector with the aligned apertures in the ground sheet and conductive chassis member and orienting the connector so that each locking pin is aligned with a space between two adjacent finger portions.

* * * * *